US010890406B1

(12) United States Patent
Whang

(10) Patent No.: US 10,890,406 B1
(45) Date of Patent: Jan. 12, 2021

(54) GUN REST

(71) Applicant: Colosseum Athletics Inc., Compton, CA (US)

(72) Inventor: Stuart Whang, Compton, CA (US)

(73) Assignee: Colosseum Athletics Inc., Compton, CA (US)

( * ) Notice: Subject to any disclaimer, the term of this patent is extended or adjusted under 35 U.S.C. 154(b) by 0 days.

(21) Appl. No.: 16/699,525

(22) Filed: Nov. 29, 2019

(51) Int. Cl.
*F41A 23/02* (2006.01)
*F41C 33/00* (2006.01)

(52) U.S. Cl.
CPC ..... *F41A 23/02* (2013.01); *F41C 33/001* (2013.01)

(58) Field of Classification Search
CPC ..... F41A 23/02; F41A 23/16; F41A 23/18; F41A 25/00; F16M 13/04; F16M 13/06; F41C 33/001
See application file for complete search history.

(56) References Cited

U.S. PATENT DOCUMENTS 3,621,597 A * 11/1971 Price ..... F41A 23/00 42/94
3,935,657 A * 2/1976 Wade ..... F41A 23/00 42/94
3,947,988 A * 4/1976 Besaw ..... F41A 23/00 42/94
4,438,913 A * 3/1984 Hylla ..... F41A 23/18 248/534
4,558,531 A * 12/1985 Kilby ..... F41A 23/16 42/94
4,558,532 A * 12/1985 Wright ..... F41A 23/16 42/94
5,332,185 A * 7/1994 Walker, III ..... F41A 23/02 248/346.2
5,600,913 A * 2/1997 Minneman ..... F41A 23/06 211/64
5,738,256 A * 4/1998 Goff ..... A45F 5/00 224/185
5,875,580 A * 3/1999 Hill ..... F41A 23/02 42/94
6,305,117 B1 * 10/2001 Hales, Sr. ..... F41A 23/02 42/94
6,378,235 B1 * 4/2002 Smith ..... F41A 23/02 42/94
6,397,507 B1 * 6/2002 Marshall ..... F41C 23/16 42/106
8,813,408 B1 * 8/2014 Knight, Sr. ..... F41C 33/001 224/149
9,964,254 B1 * 5/2018 Hayes ..... F41A 23/16
(Continued)

*Primary Examiner* — Joshua E Freeman
(74) *Attorney, Agent, or Firm* — Raymond Y. Chan; David and Raymond Patent Firm

(57) ABSTRACT

A gun rest includes a cushioning body and a knee strapping system. The cushioning body has a top surface, a bottom surface, a retention channel indented on the top surface for supporting a firearm barrel thereat, and a barrel grip provided at the retention channel for preventing inadvertent movement of the firearm barrel along said retention channel. The knee strapping system is extended from the cushioning body for detachably coupling the cushioning body at a knee of an operator to serve as a knee guard. Therefore, the gun rest provides a multi-function of supporting the firearm in a ready position and quickly attaching to the knee of the operator without restricting any movement.

20 Claims, 5 Drawing Sheets

(56) References Cited

U.S. PATENT DOCUMENTS 10,048,034 B1 * 8/2018 Reasor ..... F41A 23/16
10,209,023 B1 * 2/2019 Stuart ..... F41A 23/18
10,323,898 B1 * 6/2019 Phillips ..... F41A 23/16
2007/0020435 A1 * 1/2007 Williams ..... B05D 5/02 428/143
2007/0169391 A1 * 7/2007 Carpenter ..... F41A 23/14 42/94
2008/0034636 A1 * 2/2008 Potterfield ..... F41A 23/04 42/94
2008/0263928 A1 * 10/2008 Potterfield ..... F41A 23/16 42/94
2009/0188146 A1 * 7/2009 Werner ..... F41G 1/54 42/94
2010/0236125 A1 * 9/2010 Morrow ..... F41A 23/02 42/94
2011/0308131 A1 * 12/2011 McLinda ..... A01K 97/10 42/94
2012/0186125 A1 * 7/2012 Werner ..... F41A 23/18 42/94
2012/0246991 A1 * 10/2012 Seuk ..... F41A 23/16 42/94
2013/0081317 A1 * 4/2013 Mangum ..... F41C 27/22 42/94
2014/0259851 A1 * 9/2014 Cuddeback ..... E04H 12/185 42/94
2015/0059043 A1 * 3/2015 Dwyer ..... A41D 31/12 2/20
2015/0292830 A1 * 10/2015 Treadaway ..... F41A 23/04 42/94
2017/0102203 A1 * 4/2017 Cauley, Jr. ..... F41A 23/16
2017/0321986 A1 * 11/2017 Elsner ..... F41A 25/22
2019/0063862 A1 * 2/2019 Carlson ..... F41A 23/18
2019/0166933 A1 * 6/2019 Tiffin ..... A41D 19/0013
2019/0328057 A1 * 10/2019 Meredith ..... A41D 13/0562
2020/0103197 A1 * 4/2020 Coleman ..... F41C 27/22

* cited by examiner

GUN REST

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a gun accessory, and a more particularly to a gun rest which provides a multi-function of supporting a gun in a ready position and quickly attaching to a knee of an operator without restricting any movement.

Description of Related Arts

Many firearms enthusiasts require carrying various firearms and firearm accessories for outdoor target shooting or hunting. When operating a rifle, firearm enthusiasts may change different shooting positions for different purposes. For example, prone position allows the operators staying close to the ground to enhance the accuracy of firing. kneeling position allows the operators to quickly assume the shooting position. However, inadvertent of the firearm will reduce the accuracy of firing.

Gun rests are used for supporting firearms, especially rifles, during the firing operation. Gun rests are significantly usefully for supporting a heavy firearm barrel to eliminate inadvertent movement of the firearm so as to enhance the accuracy of firing. Knee pads are commonly used for protecting knees in sporting to protect the joints and knee from bruises or other injury at different shooting positions.

SUMMARY OF THE PRESENT INVENTION

The invention is advantageous in that it provides a gun rest, which provides a multi-function of supporting a gun in a ready position and quickly attaching to a knee of an operator without restricting any movement.

Another advantage of the invention is to provide a gun rest, wherein a plurality of gripping dots spacedly protruded at a retention channel for biasing against the firearm barrel.

Another advantage of the invention is to provide a gun rest, wherein the retention channel has a width gradually reducing from a rear end to a front end to restrict the barrel movement at the front end of the retention channel and to enable the limited barrel movement of at the rear end of the retention channel.

Another advantage of the invention is to provide a gun rest, wherein two knee straps are extended to form a knee loop for quickly encircling around the knee of the operator.

Another advantage of the invention is to provide a gun rest, wherein a tension of the knee loop is adjustable by one of the knee straps and a size of the knee loop is adjustable by another knee strap to ensure the knee loop fittingly encircling around the knee of the operator.

Another advantage of the invention is to provide a gun rest, wherein no expensive or complicated structure is required to employ in the present invention in order to achieve the above mentioned objects. Therefore, the present invention successfully provides an economic and efficient solution for retaining the firearm in a ready position so as to prevent inadvertent movement of the firearm barrel along the retention channel and for quickly attaching to the knee of the operator without restricting any movement.

Additional advantages and features of the invention will become apparent from the description which follows, and may be realized by means of the instrumentalities and combinations particular point out in the appended claims.

According to the present invention, the foregoing and other objects and advantages are attained by a gun rest, comprising:

a cushioning body having a top surface, a bottom surface, a retention channel indented on the top surface for supporting a firearm barrel thereat, and a barrel grip provided at the retention channel for preventing inadvertent movement of the firearm barrel along the retention channel; and a knee strapping system extended from the cushioning body for detachably coupling the cushioning body at a knee of an operator to serve as a knee guard.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
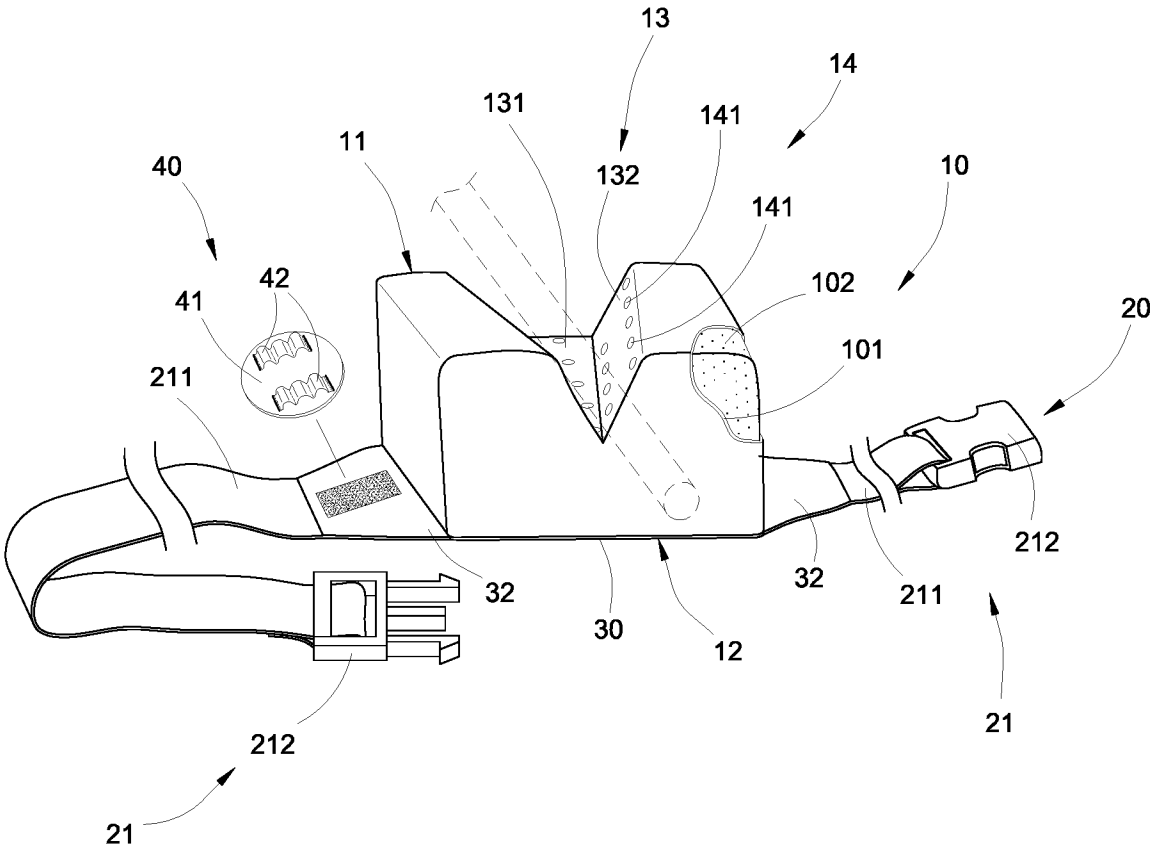
FIG. 1 is a perspective view of a gun rest according to a preferred embodiment of the present invention.
Figure 2:
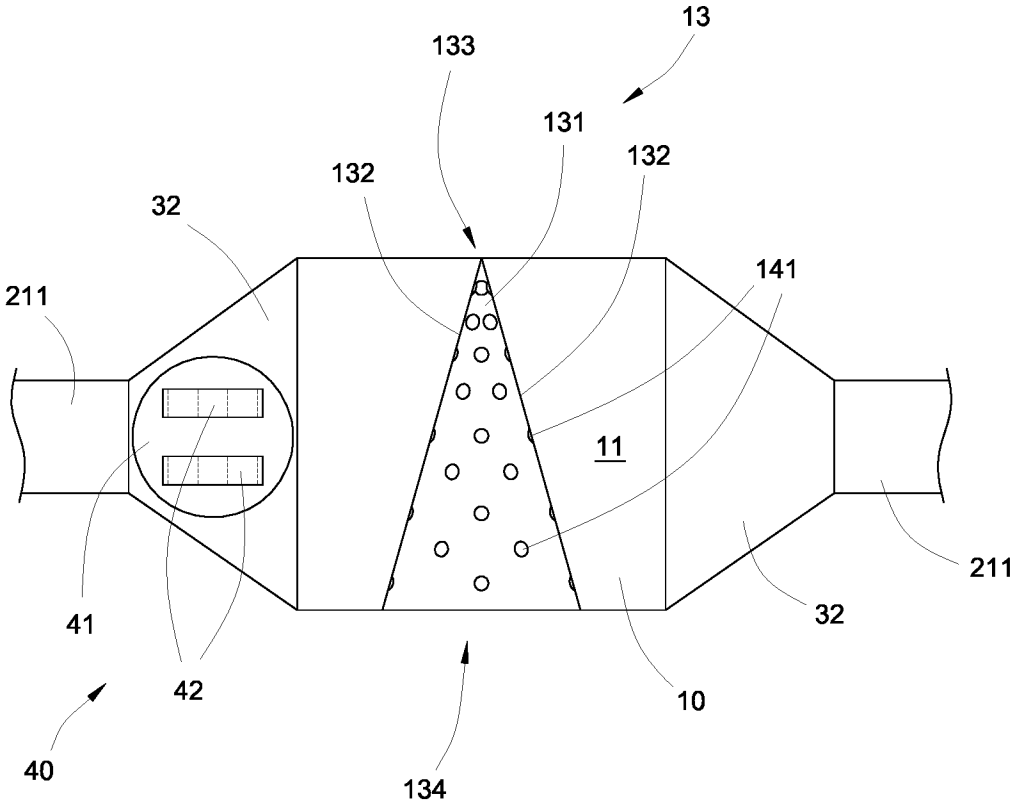
FIG. 2 is a top view of the gun rest according to the above preferred embodiment of the present invention.
Figure 3:
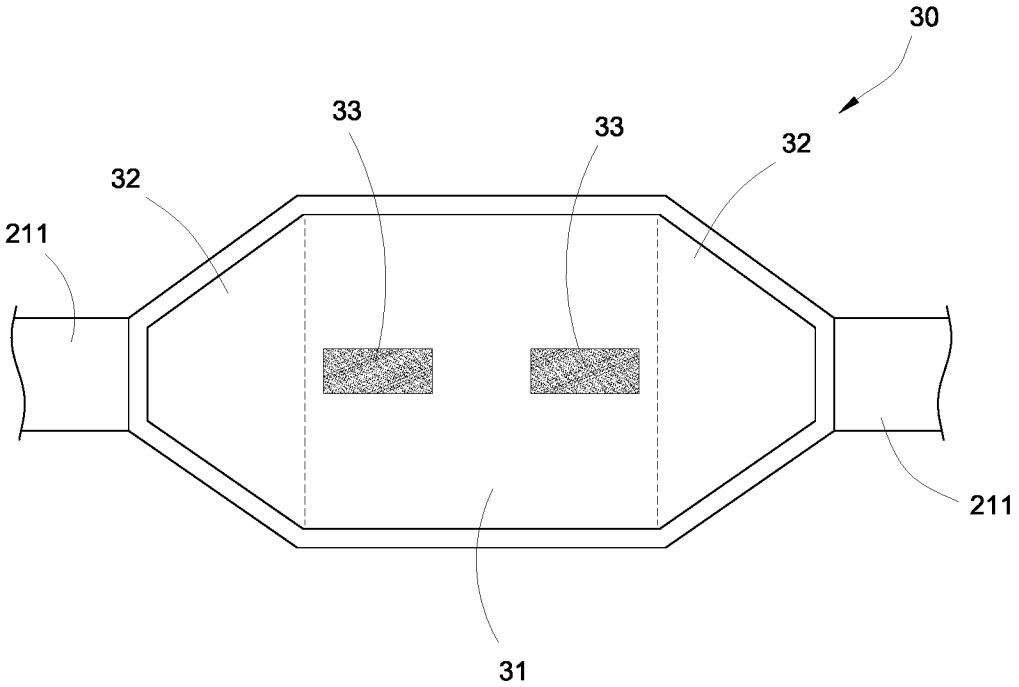
FIG. 3 is a bottom view of the gun rest according to the above preferred embodiment of the present invention.

Referring to FIGS. 1 to 3 of the drawings, a gun rest according to a preferred embodiment of the present invention is illustrated, wherein the gun rest comprises a cushioning body 10 and a knee strapping system 20.

The cushioning body 10 has a top surface 11, a bottom surface 12, a retention channel 13 indented on the top surface 11 for supporting a firearm barrel F thereat, and a barrel grip 14 provided at the retention channel 13 for preventing inadvertent movement of the firearm barrel F along the retention channel 13.

The knee strapping system 20 is extended from the cushioning body 10 for detachably coupling the cushioning body 10 at a knee of an operator to serve as a knee guard.

According to the preferred embodiment, the cushioning body 10 is constructed to have an outer sleeve 101 and a cushioning element 102 enclosed therewithin. The outer sleeve 101 is made of durable fabric with a military camouflage pattern printed thereon. The cushioning element 102 is made of foam material and is film enough for supporting the firearm barrel when the cushioning body 10 is used as the gun rest and is soft enough for protecting the knee of the operator when the cushioning body 10 is used as a knee guard.

As shown in FIGS. 1 to 3, the cushioning body 10 generally has a rectangular shape, wherein the retention channel 13 is downwardly extended from the top surface 11 toward the bottom surface 12. Preferably, the bottom surface 12 of the cushioning body 10 is a flat surface. Preferably, a length of the cushioning body 10 between the front and rear side thereof is about 3 inches, a width of the cushioning body 10 between two sides thereof is about 4 inches, a height of the cushioning body 10 between the top and bottom surfaces 11, 12 thereof is about 2.25 inches.

Accordingly, the retention channel 13 has a width reducing from top to bottom. The width of the barrel channel 13 is also gradually increasing from a front side of the cushioning body 10 to a rear side thereof. Particularly, the retention channel 13 has a bottom channel wall 131 and two side channel walls 132, wherein the side channel walls 132 are inclinedly extended at two sides of the bottom channel wall 131. In one example, the bottom channel wall 131 has a triangular shape and each of the side channel walls 132 has a rectangular shape. The side channel walls 132 are inclinedly extended at a position that a distance between the side channel walls 132 is gradually increasing from the front side of the cushioning body 10 to the rear side thereof. Therefore, the retention channel 13 is configured to have a V-shaped front opening end 133 and a flat rear opening end 134. The front opening end 133 of the retention channel 13 is arranged for retaining the firearm barrel thereat as a supporting point, such that the movement of the firearm barrel at the front opening end 133 of the retention channel 13 is limited. The rear opening end 134 of the retention channel 13 for allowing the firearm barrel being moved with respect to the supporting point so as to provide a limited movement of the firearm barrel between the side channel walls 132.

According to the preferred embodiment, the barrel grip 14 comprises a plurality of gripping dots 141 spacedly formed at the retention channel 13 for biasing against the firearm barrel. Preferably, the gripping dos 141 are outwardly protruded along the retention channel 13. In one embodiment, each of the gripping dots 141 is a hemispherical dome protruded from the retention channel 13. Preferably, each of the gripping dots 141 is made of silicon to provide a friction against the firearm barrel when the firearm barrel is supported at the retention channel 13. A diameter of each of the gripping dots 141 is about 0.25 inch. Preferably, the gripping dots 141 are identical.

Figure 4:
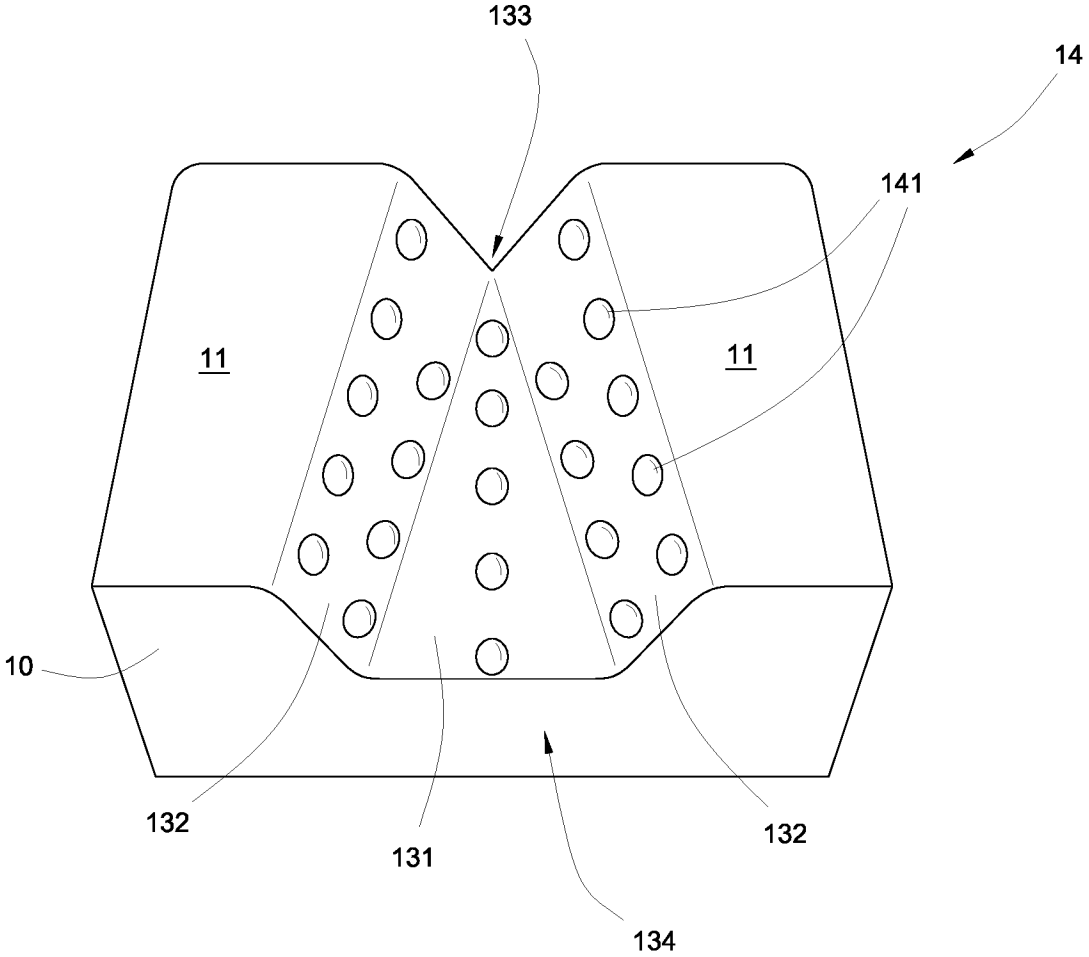
FIG. 4 illustrates a layout of the barrel grip of the gun rest according to the above preferred embodiment of the present invention.

As shown in FIG. 4, the gripping dots 141 are aligned with each other and are lined up along the retention channel 13. Particularly, the gripping dots 141 are spacedly formed on the bottom channel wall 131 and the side channel walls 132 of the barrel channel 13. In one embodiment, five sets of gripping dots 141 are lined up along the retention channel 13. The first set of gripping dots 141 is lined up along a mid-portion of the bottom channel wall 131 to align with the front opening end 133 of the retention channel 13. Therefore, one of the gripping dots 141 is located close to the front opening end 133 of the retention channel 13 to prevent inadvertent movement of the firearm barrel thereat. The second and third sets of gripping dots 141 are lined up along two connection lines between the bottom channel wall 131 and the side channel walls 132. In other words, the second set of gripping dots 141 is lined up along one of the connection lines between the bottom channel wall 131 and one of the side channel walls 132 while the third set of gripping dots 141 is lined up along another connection lines between the bottom channel wall 131 and another side channel wall 132. The fourth and fifth sets of gripping dots 141 are lined up at the side channel walls 132 respectively. Particularly, the fourth and fifth sets of gripping dots 141 are lined up at the side channel walls 132 close to the top surface 11 of the cushioning body 10.

It is worth mentioning that the first set of gripping dots 141 is configured to form a guidance for the operator to retain the firearm barrel at the retention channel 13 so as to ensure the firearm barrel aligned with the front opening end 133 of the retention channel 13. The second and third sets of gripping dots 141 are configured to retain the firearm barrel at the bottom channel wall 131 wherein the second and third sets of gripping dots 141 form two wall boundary lines to limit the firearm barrel at the bottom channel wall 131. The fourth and fifth sets of gripping dots 141 are configured to retain the firearm barrel within the retention channel 13, wherein the fourth and fifth sets of gripping dots 141 form two channel boundary lines to limit the firearm barrel within the retention channel 13.

Figure 5:
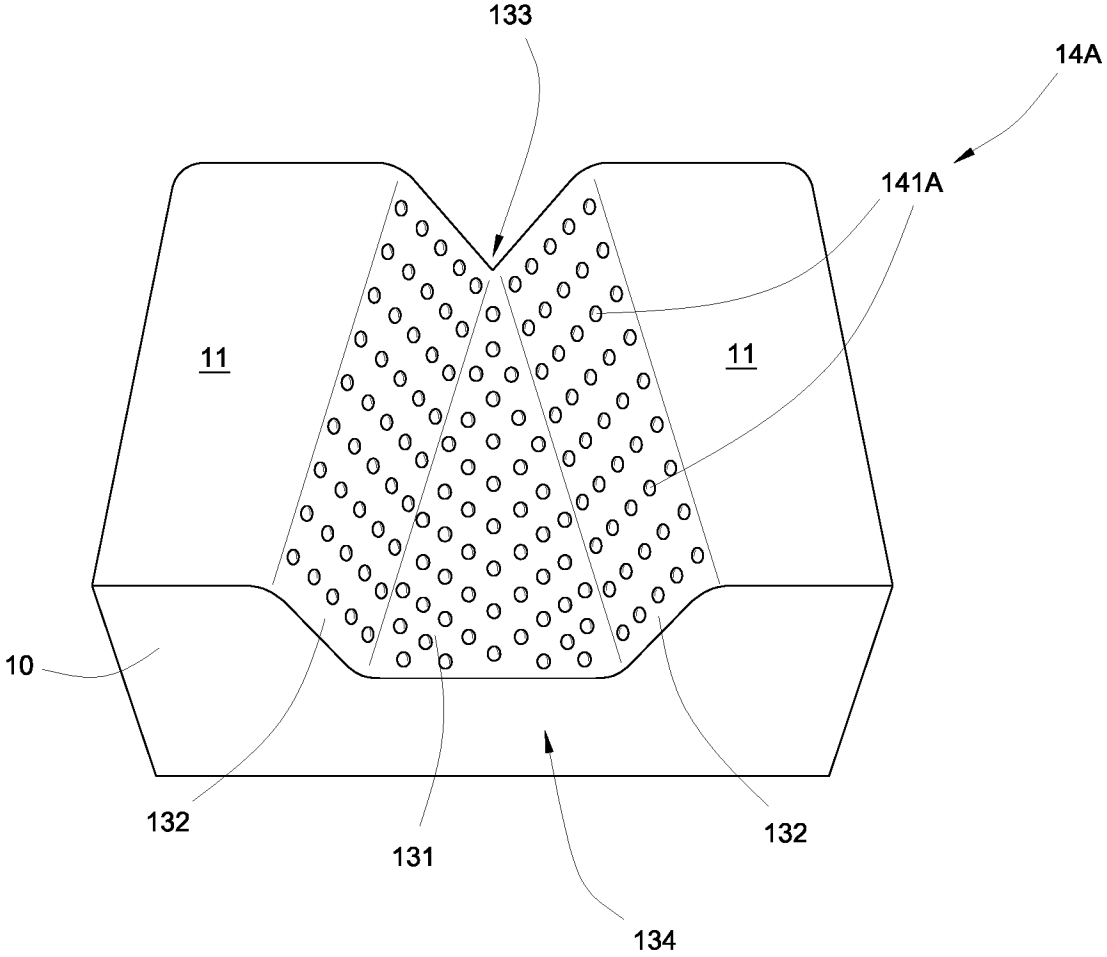
FIG. 5 illustrates an alternative layout of the barrel grip of the gun rest according to the above preferred embodiment of the present invention.

Alternatively, the barrel grip 14A comprises a plurality of gripping dots 141A spacedly formed at the retention channel 13 for biasing against the firearm barrel, as shown in FIG. 5. The size of the gripping dots 141A as shown in FIG. 5 is smaller than the size of the gripping dots 141 as shown in FIG. 4. The gripping dots 141A are evenly provided on the bottom channel wall 131 and the side channel walls 132 of the retention channel 13.

As shown in FIGS. 1 and 3, the gun rest further comprises a bottom panel 30 attached to the bottom surface 12 of the cushioning body 10, wherein the bottom panel 30 is a soft panel being contacted with the knee of the operator when operator wears the gun rest. Accordingly, the bottom panel 30 has a main body 31 attached to the bottom surface 12 of the cushioning body 10 and two side wings 32 integrally extended from two sides of the main body 31. The bottom panel 30 provides a relative stiffness to the cushioning body 10 for resting on a surface when the cushioning body 10 is used as the gun rest. Preferably, the bottom panel 30 is made of PU fabric. The bottom panel 30 further comprises at least a quick fastener 33 provided at a bottom side of the bottom panel 30. As shown in FIG. 3, two quick fasteners 33 are spacedly formed at the main body 31, wherein the quick fastener 33 is embodied as hoop and loop fasteners. Preferably, a width of each of the side wings 32 is about 1 inch.

According to the preferred embodiment, the knee strapping system 20 comprises two knee strap units 21 extended from two sides of the bottom panel 30 respectively. Particularly, the knee strap units 21 are extended from the side wings 32 of the bottom panel 30.

As shown in FIGS. 1 and 3, each of the knee strap units 21 comprises a knee strap 211 extended from the bottom panel 30 and a quick accessing connector 212 provided at a free end of the knee strap 211. When the quick accessing connectors 212 are detachably coupled with each other, the knee straps 211 form a knee loop for detachably coupling the cushioning body 10 at the knee of the operator.

The knee straps 211 are extended from the side wings 32 of the bottom panel 30, wherein one of the knee straps 211 is a length-adjustable strap and another knee strap 212 is an elastic strap. Accordingly, for forming the knee loop, the length-adjustable strap 211 is arranged to adjust a size of the knee loop to have a tight fit while the elastic strap 211 is arranged to provide an elastic force for the knee loop to secure the cushioning body 10 at the knee of the operator. Preferably, a width of each of the knee straps 211 is about 0.75 inches, a length of the length-adjustable strap is about 18 inches, and a length of the elastic strap is about 2 inches.

In one embodiment, the quick accessing connectors 212 are snap and buckle connectors to provide a quick and easy connection to form the knee loop. It is worth mentioning that when the knee loop is formed, the quick accessing connectors 212 are located at a side of the knee, either the right side or the left side thereof, to ensure the knee movement of the operator.

According to the preferred embodiment, the gun rest further comprises an ammo holder 40 held by the knee strapping system 20, wherein the ammo holder 40 comprises a holder base 41 coupled at one of the knee straps 211 and a plurality of ammo loops 42 provided on the holder base 41 for holding ammos thereat. Accordingly, the holder base 41 is detachably held at one of the side wings 32 of the bottom panel 30 via the knee strap 211. Furthermore, each of the ammo loops 42 is made of elastic material to hold the ammo by means of elastic force. Preferably, the ammo loops 42 are formed in two rows, wherein each row contains three ammo loops 42. The two rows of ammo loops 42 are coaxially aligned with each other.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A gun rest, comprising:

a cushioning body having a top surface, a bottom surface, a front side, a rear side, a retention channel indented on said top surface for supporting a firearm barrel thereat, and a barrel grip provided at said retention channel for preventing inadvertent movement of the firearm barrel along said retention channel, wherein a width of said retention channel is gradually increasing from said front side of said cushioning body to said rear side thereof, wherein said width of said retention channel is reducing from top to bottom, such that said retention channel is configured for limiting a movement of the firearm barrel at said front side of said cushioning body and for allowing the firearm barrel at said rear side of said cushioning body; and a knee strapping system extended from said bottom surface of said cushioning body for detachably coupling said cushioning body at a knee of an operator to serve as a knee guard.

2. The gun rest, as recited in claim 1, wherein said barrel grip comprises a plurality of gripping dots spacedly and outwardly protruded at said retention channel for biasing against the firearm barrel, wherein said gripping dots are made of material different from a material of said cushioning body.

3. The gun rest, as recited in claim 2, wherein said gripping dots are aligned with each other and are lined up along said retention channel.

4. The gun rest, as recited in claim 3, wherein said retention channel has a bottom channel wall and two side channel walls, wherein said gripping dots are spacedly formed and are lined-up on said bottom channel wall and said side channel walls of said retention channel.

5. The gun rest, as recited in claim 4, wherein said bottom channel wall is a flat surface and has a triangular shape to configure said width of said retention channel being gradually increased from said front side of said cushioning body to said rear side thereof.

6. The gun rest, as recited in claim 5, wherein said side channel walls, each having a rectangular shape, are inclinedly extended at a position that a distance between said side channel walls is gradually increasing from said front side of said cushioning body to said rear side thereof.

7. The gun rest, as recited in claim 5, wherein said retention channel has a V-shaped front opening end at said front side of said cushioning body for retaining the firearm barrel thereat as a supporting point, and a flat rear opening end at said rear side of said cushioning body for allowing the firearm barrel being moved with respect to said supporting point.

8. The gun rest, as recited in claim 7, wherein said cushioning body comprises an outer sleeve made of durable fabric and a cushioning element made of foam material, wherein said barrel grip is made of silicon.

9. The gun rest, as recited in claim 8, further comprising a bottom panel attached to said bottom surface of said cushioning body, wherein said knee strapping system comprises two knee strap units extended from two sides of said bottom panel respectively.

10. The gun rest, as recited in claim 9, wherein each of said knee strap units comprises a knee strap extended from said bottom panel and a quick accessing connector provided at a free end of said knee strap, such that when said quick accessing connectors are detachably coupled with each other, said knee straps form a knee loop for detachably coupling said cushioning body at the knee of the operator.

11. The gun rest, as recited in claim 10, wherein one of said knee straps is a length-adjustable strap and another said knee strap is an elastic strap.

12. The gun rest, as recited in claim 9, wherein said bottom panel further comprises a quick fastener provided at a bottom side of said bottom panel.

13. The gun rest, as recited in claim 4, wherein said side channel walls, each having a rectangular shape, are inclinedly extended at a position that a distance between said side channel walls is gradually increasing from said front side of said cushioning body to said rear side thereof.

14. The gun rest, as recited in claim 2, wherein each of said gripping dots is a hemispherical dome protruded from said retention channel.

15. The gun rest, as recited in claim 2, wherein said retention channel has a bottom channel wall and two side channel walls, wherein said gripping dots are spacedly formed and are lined-up on said bottom channel wall and said side channel walls of said retention channel.

16. The gun rest, as recited in claim 1, wherein said retention channel has a V-shaped front opening end at said front side of said cushioning body for retaining the firearm barrel thereat as a supporting point, and a flat rear opening end at said rear side of said cushioning body for allowing the firearm barrel being moved with respect to said supporting point.

17. The gun rest, as recited in claim 1, wherein said cushioning body comprises an outer sleeve made of durable fabric and a cushioning element made of foam material, wherein said barrel grip is made of silicon.

18. The gun rest, as recited in claim 1, further comprising a bottom panel attached to said bottom surface of said cushioning body, wherein said knee strapping system comprises two knee strap units extended from two sides of said bottom panel respectively.

19. The gun rest, as recited in claim 1, further comprising an ammo holder held by said knee strapping system, wherein said ammo holder comprises a plurality of ammo loops for holding ammos thereat.

20. The gun rest, as recited in claim 1, further comprising an ammo holder held by said knee strapping system, wherein said ammo holder comprises a plurality of ammo loops for holding ammos thereat.

* * * * *